US008360634B2

(12) United States Patent
Obidi

(10) Patent No.: US 8,360,634 B2
(45) Date of Patent: Jan. 29, 2013

(54) NORMAL-TO-FLOW THERMOSTAT DESIGN

(76) Inventor: T. Yomi Obidi, Melrose Park, IL (US)

( * ) Notice: Subject to any disclaimer, the term of this patent is extended or adjusted under 35 U.S.C. 154(b) by 1075 days.

(21) Appl. No.: 12/217,488

(22) Filed: Jul. 7, 2008

(65) Prior Publication Data

US 2010/0001085 A1 Jan. 7, 2010

(51) Int. Cl.
*F01P 7/16* (2006.01)

(52) U.S. Cl. ..... 374/145; 123/41.09; 123/41.1; 236/93 R; 236/34.5

(58) Field of Classification Search ..... 374/100, 374/156, 208, 144, 145, 135, 136; 236/93 R, 236/34.5; 123/41.08, 41.1, 41.44, 41.09
See application file for complete search history.

(56) References Cited

U.S. PATENT DOCUMENTS 1,731,214 A * 10/1929 Eshbaugh ..... 236/34
3,658,243 A * 4/1972 Beatenbough et al. ..... 236/34
4,425,877 A * 1/1984 Fritzenwenger et al. .... 123/41.1
4,580,719 A * 4/1986 Long, Jr. ..... 236/34.5
4,913,101 A * 4/1990 Sliger ..... 123/41.1
5,103,774 A * 4/1992 Hirata et al. ..... 123/41.1
5,410,991 A * 5/1995 Beaudry et al. ..... 123/41.1
6,601,544 B2 * 8/2003 Friesenhahn et al. ..... 123/41.1
6,920,845 B2 * 7/2005 Lelkes et al. ..... 123/41.01
6,966,278 B2 * 11/2005 Takahashi ..... 123/41.1
7,096,831 B2 * 8/2006 Finkbeiner et al. ..... 123/41.1
7,445,161 B2 * 11/2008 Inoue ..... 236/101 C

* cited by examiner

*Primary Examiner* — Christopher Fulton
(74) *Attorney, Agent, or Firm* — Bay State IP, LLC

(57) ABSTRACT

A thermostat disposed to operate in a direction that is normal to the direction of flow of the fluid for which the thermostat regulates the temperature. In one embodiment, the thermostat comprises two mating faces, their movement being controlled either by the expansion or contraction of the carefully selected and apportioned materials in the thermostat pack or by a sensor-triggered controller in response to the temperature of the fluid to which the thermostat is exposed. The first type or Type 1 is normally closed, typically for use in liquid-cooled engines. The second type or Type 2 is normally open, typically for use in industrial applications, such as in solvent evaporation/recycle units where it is desirable to stop direct coolant flow into a paint gun cleaner or a similar equipment, when the temperature of the coolant reaches beyond a predetermined upper limit.

20 Claims, 3 Drawing Sheets

NORMAL-TO-FLOW THERMOSTAT DESIGN

FIELD OF INVENTION

This invention relates generally to cooling systems in internal combustion engines and to solvent flow thermal control in chemical, environmental and distillation processes. In particular, this invention relates to the thermostat design and to the thermostat port or thermostat housing design in the engine cylinder head or in a pipe flow or some thermally controlled flow path.

BACKGROUND OF INVENTION

Internal combustion engines convert chemical energy from the supplied fuel in the form of gasoline, diesel, propane, natural gas, alcohol or some combination thereof to mechanical energy to drive the engine.

Most internal combustion engines employ a cooling system to circulate coolant through the engine. The coolant serves to remove heat from the engine in operation thereby preserving the engine materials and the gaskets from overheating and consequently failing. The coolant path in an engine begins from the water pump. The path continues through the crankcase and cylinder head, branching along the way to other components that may be present, such as the oil cooler and the exhaust gas recirculation (EGR) system. The coolant exits the engine into the radiator through the thermostat. In the radiator, the heat in the coolant is extracted into the environment so that the coolant returns to the water pump from the radiator at a relatively cooler temperature than when the same coolant left the thermostat to go into the radiator.

Internal combustion engines typically possess a thermostat port in the cylinder head or just outside the cylinder block, before the radiator inlet. The typical arrangement of the thermostat port and the thermostat bypass port in the cylinder head is such that the bypass and the main flow ports are in-line with the coolant flow. The typical thermostat design uses up nearly one third of the pressure developed at the water pump to overcome the constriction inherent in the thermostat design. Also, in traditional thermostat design, there is a bypass flow of as much as one eighth of coolant specified flow rate when the thermostat is fully open. This, unfortunately, is typically not taken into account in the determination of the amount of coolant flowing through the thermostat.

It takes a while for the thermostat to be fully open in the traditional thermostat design. There is a continuous variable-rate surge of coolant, and the thermostat, as a result, bounces throughout engine operation even when the thermostat is fully open. Also, in the current design, especially in trucks, the architecture to contain the thermostat forces a high hood with a less-than-desirable aerodynamic design. There is a need for a more effective thermostat. Such a thermostat would have a lower pressure loss across it, would eliminate or substantially reduce the by-pass coolant flow when the thermostat is fully open, and would open and close more effectively with minimal bounce or vibration throughout an engine operation.

SUMMARY OF INVENTION

The instant invention, as illustrated herein, is clearly not anticipated, rendered obvious, or even present in any of the prior art mechanisms, either alone or in any combination thereof. A, normal-to-flow thermostat design adapted to compensate for the aforementioned drawbacks and limitations would afford significant improvement to numerous useful applications. Thus the several embodiments of the instant invention are illustrated herein.

The invention provides a normal-to-flow thermostat design in which the thermostat opens and closes in a direction normal to the coolant flow which the thermostat controls. The normal-to-flow thermostat is either normally closed (Type 1) or normally open (Type 2), with the normally closed thermostat intended for automotive engines, and the normally open (Type 2) considered for solvent for in parts and equipment washers where the solvent is coming into the parts washer from, say, a distillation unit, and where it is desirable to stipulate an upper limit to the temperature of the solvent, especially where the solvent is being used directly by an operator at the parts washer.

The pressure drop across the instant thermostat is substantially reduced compared with the current thermostat design. The cumbersome thermostat housing is eliminated in this design, giving room for a more compact design. With instant thermostat, since thermostat movement is lateral the high-hood constraint is eliminated. The invention eliminates the unintended coolant leakage in the form of thermostat bypass flow when the bypass is supposed to be fully closed. Also, it allows both for faster thermostat opening and for instant thermostat opening, the latter being effected with an electronic control.

The invention, Obidi type thermostat, eliminates the galloping motion typical of the thermostat. This is made possible due to the coolant flow path being normal to the direction of thermostat opening and closing. The invention also makes possible a tighter temperature range definition for fully open thermostat.

Other systems, methods, features and advantages of the invention will become apparent to one with skill in the art upon examination of the following figures and detailed description. It is intended that all such additional systems, methods, features and advantages, including but not limited to cylinder head design, be included within this description, be within the scope of the invention, and be protected by the following claims.

Accordingly, an improved thermostat mechanism, accompanying enhancements and the component elements are herein described, which achieve these objectives, plus other advantages and enhancements. These improvements to the art will be apparent from the following description of the invention when considered in conjunction with the accompanying drawings wherein there has thus been outlined, rather broadly, the more important features of the improved thermostat mechanisms in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

BRIEF DESCRIPTION OF THE DRAWINGS

The invention can be better understood by referring to the following drawings and description. The components in the figures are not necessarily to scale; the emphasis is rather on the illustrating principles of the invention. Furthermore, in the figures, like-referenced numerals designate corresponding parts throughout the different views;

FIG. 4 illustrates the closed position for the Type 2 wherein a response to a trigger has occurred.

DETAILED DESCRIPTION OF THE SEVERAL EMBODIMENTS

Figure 1:
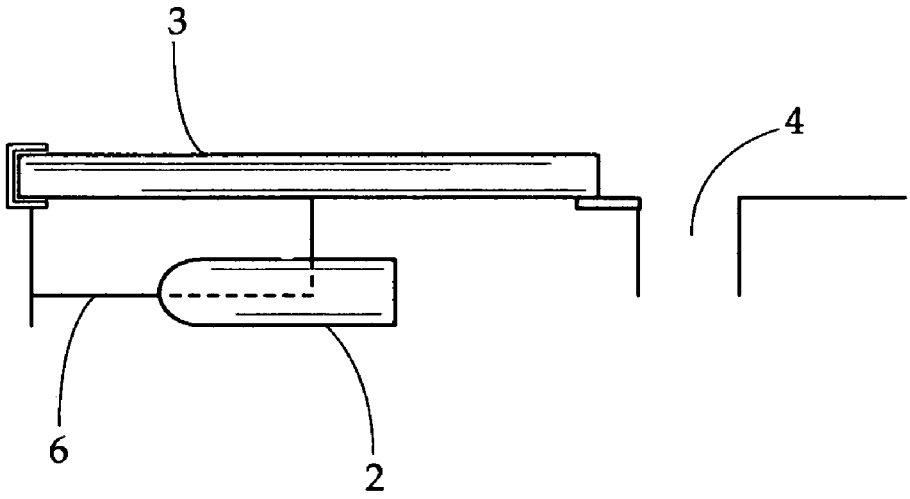
FIG. 1 is a side view of the Type 1 thermostat.
Figure 5:
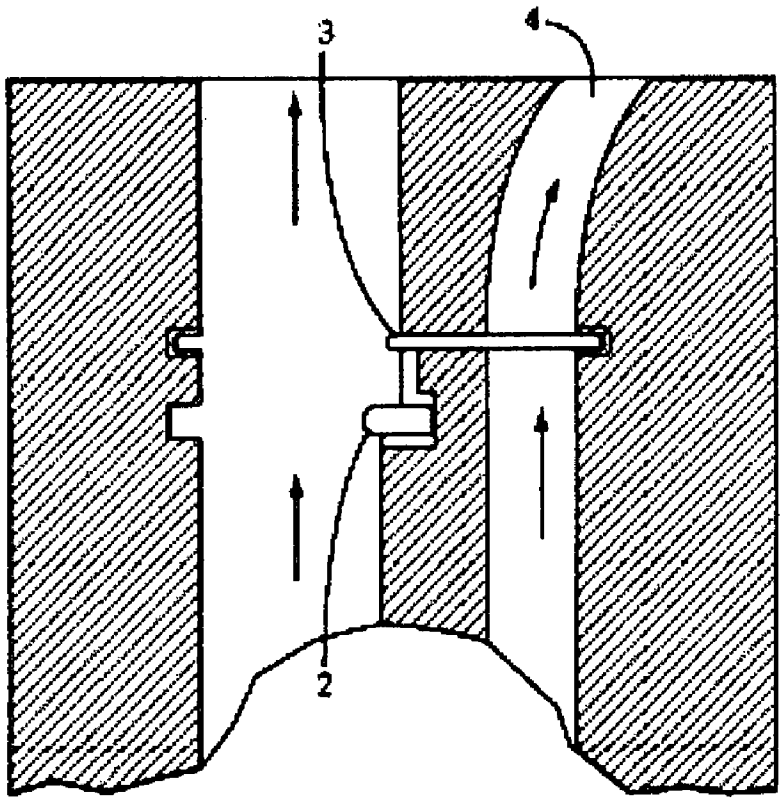
FIG. 5 illustrates the open position for the Type 1 wherein a response to a trigger has occurred; and, FIG. 5 is a side view of the Type 2, in the normal position (normally open) and thus

The following describes the design and workings of the normal-to-flow thermostat. As shown in FIG. 1 and FIG. 5, the sliding disc 3 is in the normally-closed position, with the bypass 4 open. The slider or spring 6 is attached to the fixed end 1, the same which would be the fixed disc or the second sliding disc 3 in a two-disc arrangement. The disc 3 may be circular as illustrated, semi-circular or rectangular, or any combination thereof in order to accommodate piping arrangements and flow control. The system can utilize one disk or two disks and the two disk embodiments is best suited for high performance engines.

The chemico-thermal pack or electronic module 2 transfers the expansion within the pack into a sliding motion along the axis of the slider 6. As illustrated in FIG. 5, the coolant path 5 to the radiator is shown for the thermostat in the open position. The bypass 4 allows coolant to flow and re-circulate, bypassing the radiator, thereby expediting the heating of the coolant and the consequential expansion of the thermostat and the sliding of the thermostat disc into an open position.

The normally open position illustrated in FIG. 5 allows solvent flow-through as long as the coolant or solvent temperature is below a prescribed upper limit. The thermostat closes 2 when the temperature reaches the critical value. The attachment of the thermostat packing material/control to the thermostat moving disc/plate is typically done by welding, bolting or any combination thereof, a piece of metal to the thermostat disc 3 at one end and to the thermostat packing 2 directly or indirectly at the other end. In the Type 1 design, the attachment to thermostat packing is on the left side of the packing 6 whereas, in the Type 2 design, the attachment is to the right end of the packing.

The control of the plate 3 could be by a spring, a slider, or an electronic device. It could be a direct control as shown or an indirect control or some combination thereof. The normally open position allows solvent flow-through as long as the coolant or solvent temperature is below a prescribed upper limit. The thermostat closes when the temperature reaches the critical value.

FIG. 1 illustrates a cross-section of the type 1 thermostat in a cylinder head. The coolant path 5 to the radiator is shown for the thermostat in the open position. The bypass 4 allows coolant to flow and re-circulate, bypassing the radiator, thereby expediting the heating of the coolant and the consequential expansion of the thermostat and the sliding of the thermostat disc into an open position.

The Type 2 thermostat has its applications in industrial processes, unlike as in engines as illustrated in the Type 1 design. An example of Type 2 application is in a flow process whereby the flow (say, to a spout where it is directly used—i.e. comes in contact with the skin of an equipment operator) is cut off when the fluid (usually liquid but can be gas) exceeds certain specified value. This over-temperature flow could occur if the heat exchanger were to fail while an evaporation/distillation process continued.

Figure 2:
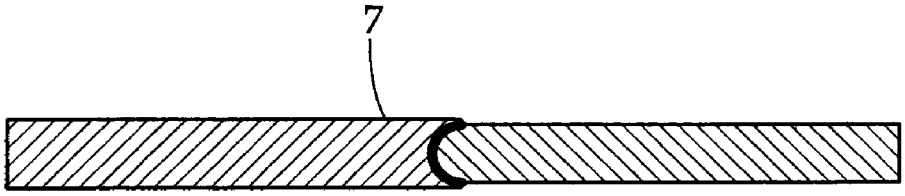
FIG. 2 is a side view of a two-disc thermostat in a normally-closed position, with the two discs interfacing and sealing to form a port blocking seal.
Figure 3:
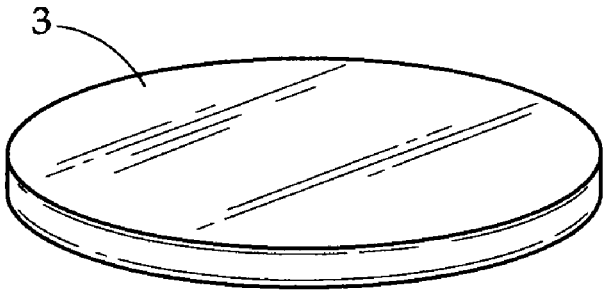
FIG. 3 is a top view of an individual sliding disc 3. The disc could be circular as shown or semi-circular or rectangular or any combination thereof.
Figure 4:
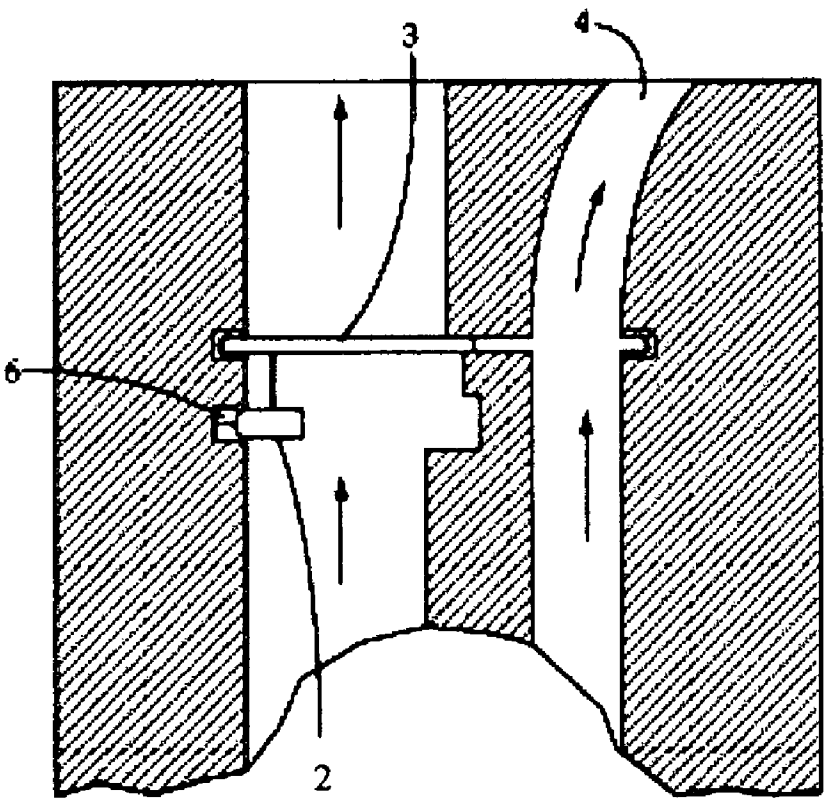
FIG. 4 is a side view of the Type 1, in the normal position (normally closed) and thus

Therefore, if the two-disc thermostat design 7 illustrated in FIG. 2 is used, as may be the case for performance engines, in place of item 3, then the interlocking plates would move in opposite directions, from the normally closed position FIG. 4, with one piece moving to cover the bypass, as in FIG. 5 and the other piece sliding leftward into the cylinder wall, which would then require a deeper recess. This may be accomplished utilizing one or two thermostat assemblies.

Figure 6:
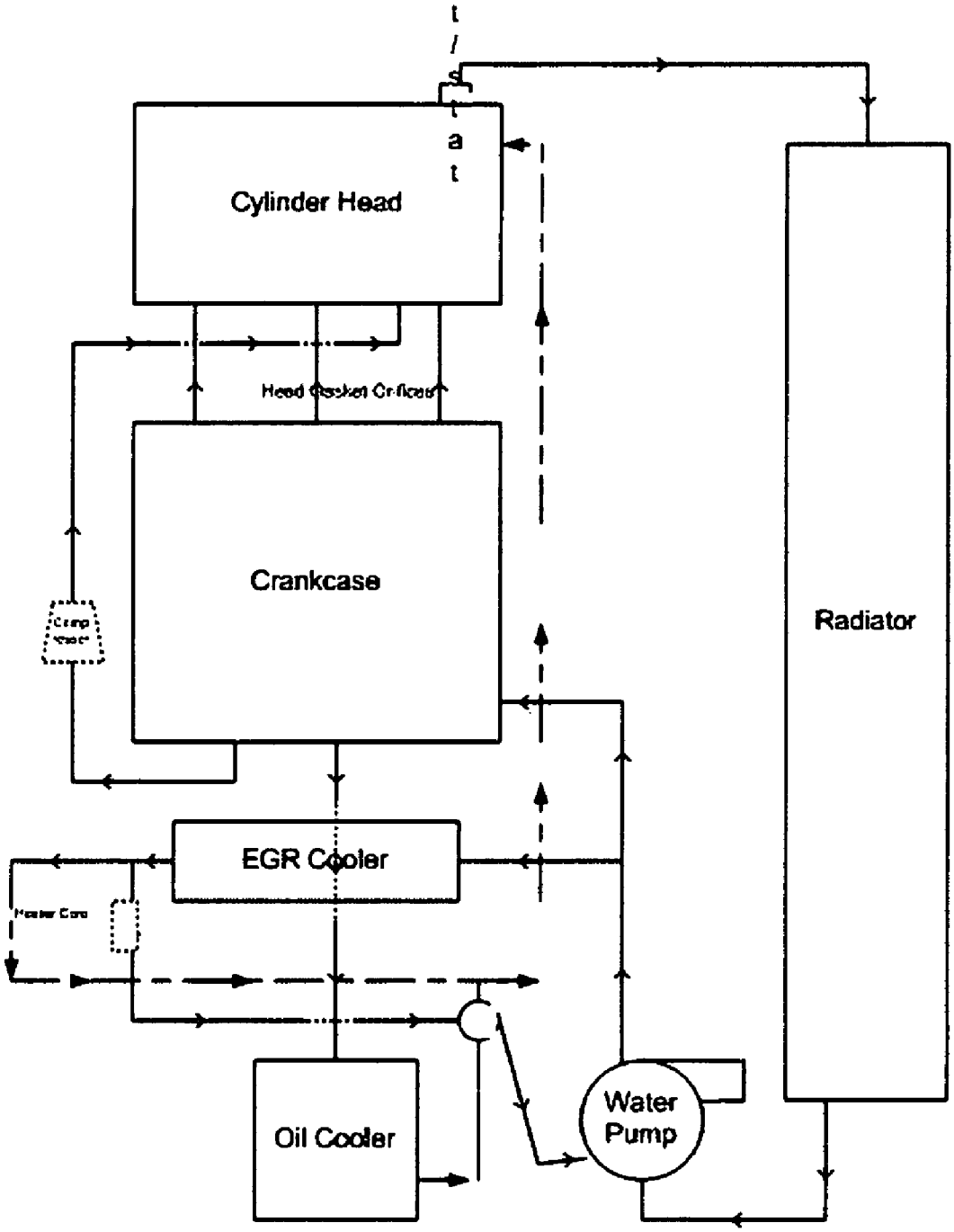
FIG. 6 is a schematic view of a typical engine coolant flow path.

Finally, FIG. 6 is a schematic view of a typical engine coolant flow path in order to place the instant invention in the context for proper use. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An extension/retraction system for a thermostat mechanism comprising: a spring pack mechanism comprising a measured material compound, a first portion and second portion; at least one thermostat mating plate wherein a first portion of said spring pack mechanism is attached to said at least one thermostat mating plate and wherein a second portion of said spring pack is attached to a mating surface; wherein said first portion of said spring pack and said second portion of said spring pack move translationally relative to the each other, and wherein said at least one thermostat mating plate moves in parallel with said mating surface; and, wherein upon operation, said at least one mating plate performs a translational motion to mate with said mating surface.

2. The extension/retraction system for a thermostat mechanism of claim 1 wherein said spring pack restricts relative motion between said at least one mating plate and said mating surface.

3. The extension/retraction system for a thermostat mechanism of claim 1 comprising a normal-to-direction-of-flow thermostat mechanism comprising: at least two mating discs, wherein a first of said at least two mating discs comprises a fixed slot disposed at an outer periphery of said first of said at least two mating discs and wherein said fixed slot disposed at an outer periphery of said first of said at least two mating discs mates with an outer periphery of said second of said at least two mating discs.

4. The extension/retraction system for a thermostat mechanism of claim 3 wherein said fixed slots are gasket-fitted to ensure proper sealing of the thermostat when in a closed position.

5. The extension/retraction system for a thermostat mechanism of claim 4 further comprising a chemico-mechanical temperature-sensing device.

6. The extension/retraction system for a thermostat mechanism of claim 5 wherein said chemico-mechanical temperature-sensing device is a thermostat pack-and-spring assembly.

7. The extension/retraction system for a thermostat mechanism of claim 6 further comprising a controlled-motion device which creates motion by the expansion of said thermostat pack-and-spring assembly.

8. The extension/retraction system for a thermostat mechanism of claim 7 wherein said mechanism is disposed in normally closed position.

9. The extension/retraction system for a thermostat mechanism of claim 7 wherein said mechanism is disposed in a normally open position.

10. The extension/retraction system for a thermostat mechanism of claim 4 further comprising an electronic temperature-sensing device.

11. The extension/retraction system for a thermostat mechanism of claim 10 wherein said electronic temperature-sensing device further comprising a trigger temperature sensor.

12. The extension/retraction system for a thermostat mechanism of claim 10 further comprising a controlled-motion device, which creates motion by an electronic motion control activated sensor.

13. The extension/retraction system for a thermostat mechanism of claim 12 wherein said mechanism is disposed in normally closed position.

14. The extension/retraction system for a thermostat mechanism of claim 13 wherein at least one of said at least two mating discs possesses an extension for opening and closing the engine coolant bypass port in alternate concert to the main coolant port.

15. The extension/retraction system for a thermostat mechanism of claim 14 wherein said extension is selected from the group consisting of circular, rectangular and a combination of circular/rectangular.

16. The extension/retraction system for a thermostat mechanism of claim 12 wherein said mechanism is disposed in a normally open position.

17. The extension/retraction system for a thermostat mechanism of claim 4 wherein said first disc comprises a metallic material and wherein said second disc comprises a metallic material.

18. The extension/retraction system for a thermostat mechanism of claim 4 wherein said first disc comprises at least one point of connection welded to said controlled-motion device and wherein said second disc comprises at least one point of connection welded to said controlled-motion device.

19. The extension/retraction system for a thermostat mechanism of claim 1 comprising a thermostat mechanism comprising: at least one mating disc, wherein said at least one mating disc comprises a fixed slot disposed at an outer periphery of said at least one mating disc disposed to mate with a fixed slot in a receiving mechanism; and, wherein said at least one mating disc possesses an extension for opening and closing an engine coolant bypass port in alternate concert to a main coolant port; and, wherein said thermostat mechanism possesses a normal to direction of flow orientation.

20. The extension/retraction system for a thermostat mechanism of claim 19 wherein the at least one mating disc comprises at least two mating disks and wherein the pressure drop across said thermostat is substantially reduced due to said at least two mating disks.

* * * * *